US005166463A

United States Patent [19]

Weber

[11] Patent Number: 5,166,463

[45] Date of Patent: Nov. 24, 1992

[54] MOTION ORCHESTRATION SYSTEM

[76] Inventor: Steven Weber, 102 Andover Pl., Robbinsville, N.J. 08691

[21] Appl. No.: 779,927

[22] Filed: Oct. 21, 1991

[51] Int. Cl.[5] ..... G10H 1/02; G10H 1/18; G10H 1/32

[52] U.S. Cl. ..... 84/600; 84/645; 84/626; 84/615; 84/725; 84/737; 84/743

[58] Field of Search ..... 84/600-603, 84/645, 723-725, 737-743, 626, 615

[56] References Cited

U.S. PATENT DOCUMENTS

| | | | |
|---|---|---|---|
| 3,749,810 | 7/1973 | Dow | 84/701 |
| 4,627,324 | 12/1986 | Zwosta | 84/464 R X |
| 4,776,253 | 10/1988 | Downes | 446/242 X |
| 4,905,560 | 3/1990 | Suzuki et al. | 84/600 |
| 4,968,877 | 11/1990 | McAvinney et al. | 250/221 |
| 4,980,519 | 12/1990 | Mathews | 178/19 |
| 4,998,457 | 3/1991 | Suzuki et al. | 84/600 |
| 5,005,460 | 4/1991 | Suzuki et al. | 84/600 |
| 5,017,770 | 5/1991 | Sigalov | 250/221 |
| 5,046,394 | 9/1991 | Suzuki et al. | 84/600 |
| 5,058,480 | 10/1991 | Suzuki et al. | 84/600 |

OTHER PUBLICATIONS

The Power Glove; Design News, Dec. 4, 1989, pp. 63, 64, 66 & 68.

Cadalyst-Dec. '89, pp. 41, 42, 43, 44, 45, 46, 47, 49, 50, 51, 52, 53.

Discover: The World of Science (transcript) Dec. 13, 1989, pp. 28, 29, 30, 31, 32, 33 & 34.

NASA Tech Briefs-Aug. '89-vol. 13, No. 8, pp. 18 & 19.

Discover: 2001-Nov. 1988-pp. 72 & 73.

*Primary Examiner*—William M. Shoop, Jr.

*Assistant Examiner*—Brian Sircus

*Attorney, Agent, or Firm*—Anthony J. Casella; Gerald E. Hespos

[57] ABSTRACT

A motion orchestration system is provided to enable an artist or orchestrator to produce music or other sounds and to extemporaneously vary the sounds being produced without detracting from the visual effect intended by the artist or orchestrator. The system may include motion detecting sensors capable of generating three-space coordinates of various segments of the body of the orchestrator. Electrical signals generated by the motion detecting sensors may generate MIDI compounds which can be converted into appropriate music or sounds. Signals from traditional microphone equipment may also be employed. The system further includes hand switching devices responsive to various hand and/or finger movements to electronically control the orchestration of the electronic output signals generated by the motion or speech of the orchestrator or by external sources. The triggering of the hand switches by appropriate touch or motion in predetermined combinations and sequences is interpreted as instructional information, and is used to alter analog or digital electrical output signals generated by the motion or speech of the orchestrator.

22 Claims, 4 Drawing Sheets

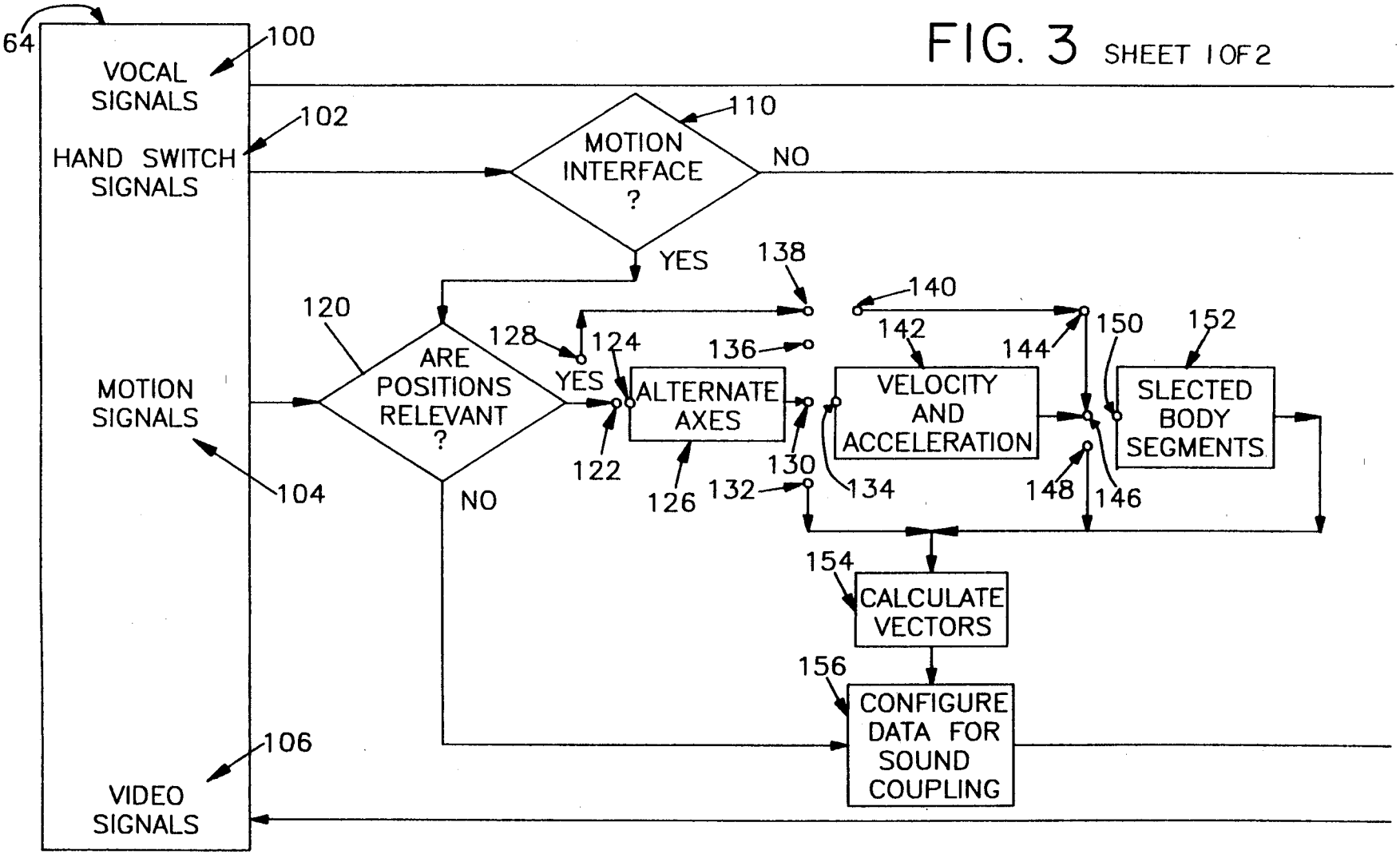
FIG. 3 SHEET 1 OF 2
VOCAL SIGNALS
HAND SWITCH SIGNALS
MOTION SIGNALS
VIDEO SIGNALS
MOTION INTERFACE ?
NO
YES
ARE POSITIONS RELEVANT ?
YES
NO
ALTERNATE AXES
VELOCITY AND ACCELERATION
SLECTED BODY SEGMENTS
CALCULATE VECTORS
CONFIGURE DATA FOR SOUND COUPLING
64
100
102
104
106
110
120
122
124
126
128
130
132
134
136
138
140
142
144
146
148
150
152
154
156

MOTION ORCHESTRATION SYSTEM

BACKGROUND OF THE INVENTION

Electrical signals can be used to produce a broad range of high quality, complex and very sophisticated music. Electrical signals generated by available equipment can produce sounds configured to resemble virtually any conventional musical instrument or an entire orchestra. The technology can be employed to overlay vocals with harmonie's and echoes and can configure the output to sound as if it were generated in different acoustic settings.

Musical Instrument Digital Interface (MIDI) circuitry and software defines an efficient and accepted electrical signaling system for generating music. However, the gallery of equipment that is required to accomplish the artist's chosen effects typically requires extensive up-front programming which requires a performer to employ a complex keyboard or other such computer hardware that limits the artist's ability to both extemporize and incorporate aesthetic body movements into a performance. Thus, an artist cannot reasonably change the musical response that will be generated from a particular electrical signal without having at his or her disposal one or more control devices that restrict movement. With conventional musical instruments this may not be a serious drawback. However, as explained herein, recent technological advances enable the artist to effectively become the instrument, thereby transcending the instrument art form to combine, for example, dance and instrumentation.

Technology is available for electronically identifying the position of a person's body or portions of the body and for measuring various movements of the body. These body measurement technologies have grown largely from research in aerospace applications, ergonomics and various computer control applications, some of which are geared toward entertainment. Body measurement systems that are available commercially or that are in the development phase employ optics, magnetics and/or properties of materials to determine the position of a selected body segme. at a particular time. Computer technology is an important part of these systems since large amounts of data must be collected, stored and manipulated almost continuously to generate position tracking information that is representative of real time events. A control apparatus for electronic musical instruments that couples MIDI commands with motion signals is disclosed, for example, in U.S. Pat. No. 4,776,253 which issued to Downes on Oct. 11, 1988. Additionally, the August 1989 Edition of *NASA Tech Briefs* reported work by McAvinney using optical sensors as having a potential future application for converting dance motions into musical accompaniment. Similar work is shown in U.S. Pat. No. 4,905,560 which issued to Suzuki, et al. on Mar. 6, 1990 and which shows a musical tone control apparatus that is mounted on a performer's body. The apparatus of U.S. Pat. No. 4,905,560 includes detectors mounted on a performer's arm for detecting bending angles of the performer's joints. Additionally, a musical tone control data generating circuit is worn on the performer's waist for generating musical tone control data based on output signals of the first and second detecting means. The tone control data generating circuit worn on the performer's waist is merely operative to receive signals from the performer's joints, and does not enable improvisation.

*NASA Tech Briefs* (August 1989), *CADalyst* (December 1989), and *Rolling Stone* (June 1990) have reported on a Data Glove and a Data Suit developed by VPL Research which rely upon optical sensing means to leasure hand and body positions. Still further, *DISCOVER: The World of Science* (Show #503) reported a glove developed at Stanford University that relies upon a metallic fabric that measures changes in its own electrical resistance as movement alters the shape of the glove. A similar concept has been employed in the Power Glove which was reported in *Design News* (December 1989) wherein a conductive ink is used to measure changes in hand movements. Additionally, LaCourse of the University of New Hampshire refers to a suit identified as the Actimeter, which employs mercury switches to measure body movement. These various prior art devices that employ gloves or body suits to generate electrical signals indicative of position or motion generally have been used for ergonomic studies and for non-verbal communications. These prior art devices are not intended to enable the person wearing the glove or body suit to effectively reprogram the signals he or she is producing.

In view of the above, it is an object of the subject invention to provide a process and an apparatus for the orchestration of electronic output signals that can subsequently be converted into sound.

Another object of the subject invention is to provide a process and apparatus that enables a performer to encode and/or use instructions that affect electrical signals generated by the performer's actions.

A further object of the subject invention is to provide a process and apparatus that enables a performer to produce at least a first set of signals in response to a first set of body movements and positions, and at least a second set of signals in response to a second selected set of body movements, such that the second signals may be operative to alter the first signals.

Yet another object of the subject invention is to provide an apparatus and process for generating instructional information to control the orchestration of electronic output signals generated by the motion or speech of a person with MIDI configured sound generators.

SUMMARY OF THE INVENTION

The subject invention is directed to a music orchestration system and a music orchestration process that employs switching theory to program and manipulate, in real time, a motion-based sound production system that does not limit the orchestrator's ability to move, program or improvise.

The apparatus of the subject invention may include first signal generating means for producing sounds or musical notes through MIDI. The first signal generating means may be operative to generate signals indicative of positions, movement, velocity and/or acceleration of selected parts of an orchestrator's body. In particular, the first signal generating means may comprise switch means mounted to selected parts of the body for generating signals indicative of body position, movement and the like. The first signal generating means may be incorporated into clothing worn by the orchestrator, such as hand wear, foot wear or bodysuits. The first signal generating means may incorporate any of the above described prior art systems for sensing body position and/or movement. For example, the apparatus of the subject invention could incorporate sensors similar to those described in the above referenced U.S. Pat. No. 4,776,253 to detect motion and to track the position of body segments relative to some axis. However, the first signal generators of the subject invention must not hinder the orchestrator's ability to move in any manner. The first signal generating means may further include voice signals and/or signal generators external of the orchestrator.

The apparatus of the subject invention further includes second signal generating means for controlling, programming and/or manipulating the first signals without visually and aesthetically disrupting the performance of the orchestrator. The second signal generating means may comprise hand mounted and/or operated switches, such that selected combinations and/or series of hand and finger movements can be measured by sensors attached to the hand to generate electronic information that is interpreted as instructions to control the overall system, including the first signal generators. For example, the right forefinger touching the right palm; the left thumb striking the side of the left forefinger; the forefinger, middle finger, ring finger and pinky of the right hand touching each other at the sides of their adjacent fingers; or all ten fingers striking the chest in rapid succession, each may constitute commands or series of commands that can be interpreted by the system to generate a response and/or to somehow alter the significance of signals generated by the first signal generators. Thus, for example, various combinations or series of hand switching signals can be employed by an orchestrator to vary the output produced by the first signal generators which may measure position and movement of various body parts. It will be appreciated that the hand switching apparatus and process will not significantly affect the visual aesthetics of a performance. On the other hand, the hand switching signals can drastically affect the output of the first signal generators, thereby enabling the orchestrator to improvise and alter the overall acoustical performance without altering the visual performance significantly.

When a sensor on the hand is triggered, that event can represent a simple switching function: i.e., on to off or off to on. However, certain types of sensors have the capability of measuring the amount of pressure that is applied to the sensor and can respond to the pressure after the sensor is triggered. These phenomena are known as pressure velocity and after-touch, and have been employed in electronic keyboards. Similar switching technology can be incorporated into the second signal generating means of the subject invention to perform similar control functions relating to the tailoring of sounds as they are coupled with body motion signals. The numerically defined MIDI commands and other numerical instructions for the system can be entered by numerical identifiers using the hand switches as the second signal generating means. For example, the Chinese counting method known as Chisembop utilizes all fingers of both hands to represent numbers. The Chisembop technique can be used to generate numerical electrical signals with the hand switches proposed herein.

The subject invention further includes a computer to receive both the first signals and the second signals, to alter the first signals in response to the second signals and to produce an output signal.

DETAILED DESCRIPTION OF THE PREFERRED EMBODIMENTS

Figure 2:
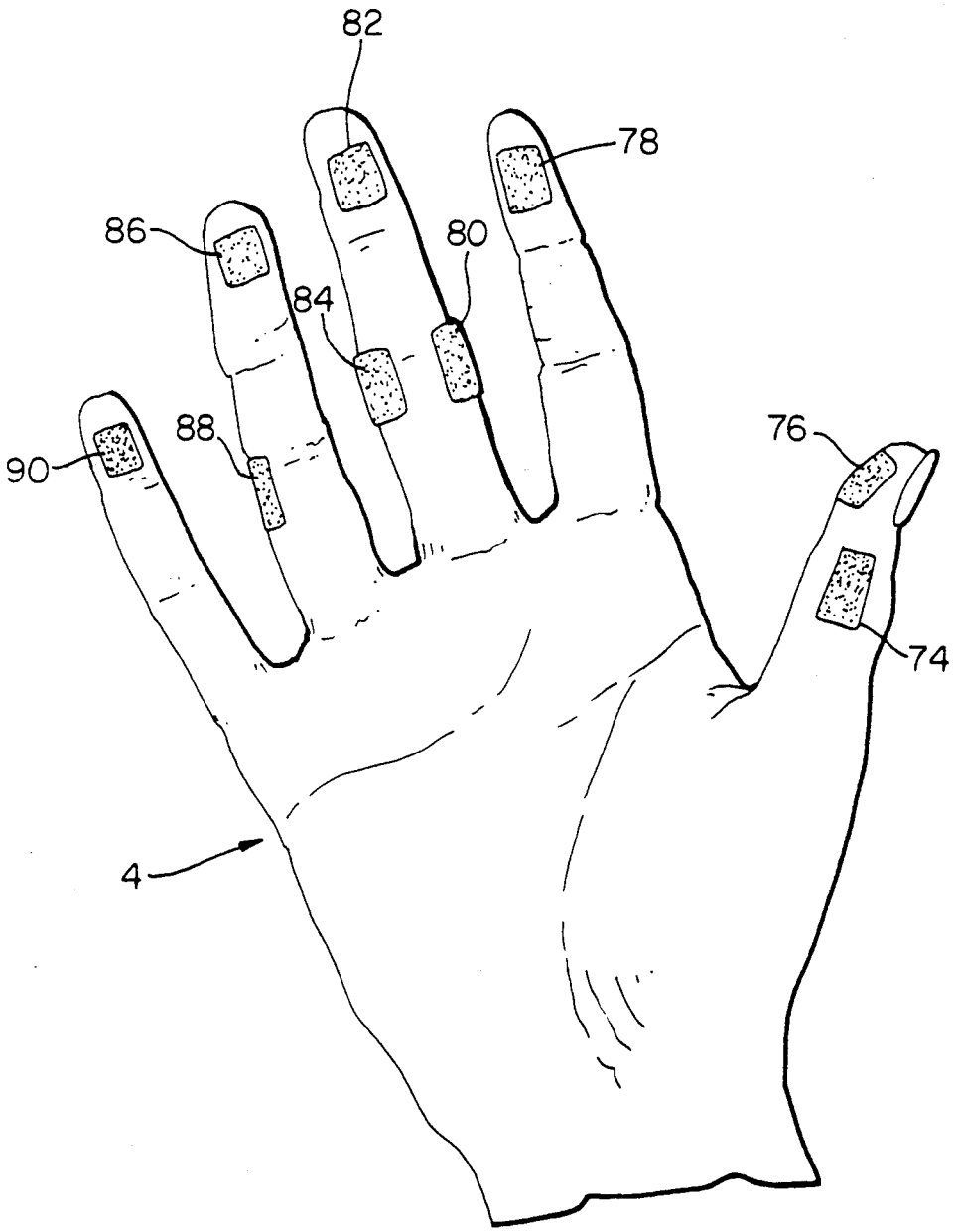
FIG. 2 is a top plan view of a glove defining a portion of the apparatus for generating signals.

FIG. depicts a preferred embodiment of a music orchestration system with some signal generators worn by the orchestrator and others not worn by the orchestrator. The music orchestration system includes a lightweight suit 2 worn on upper and lower portions of the body of the orchestrator. Motion detecting sensors and electronic wiring are stitched into the suit 2, such as in the LaCourse Actimeter described above. Glove controllers 4 are worn on both hands of the orchestrator, and are connected to wiring in the suit 2 via a cable 6 and an electrical connector 8, which is stitched into the suit 2. The glove controllers 4 may be similar to the above described VPL Data Glove, which can detect the motion and calculate the positions of the hand and fingers. However, in the preferred embodiment illustrated in FIG. 2, control of the music orchestration comes from sensors 74, 76, 78, 80, 82, 84, 86, 88 and 90 mounted on the glove controller 4. In particular the sensors 74–90 on glove controller 4 are operative to detect pressure. Additionally, sensors 76, 78, 82, 86, and 90 are operative to detect the amount of pressure being exerted as well as the duration of the exertion via processing means to provide the effects of pressure velocity and aftertouch, similar to the switch means employed in commercially available electronic keyboards.

Figure 1:
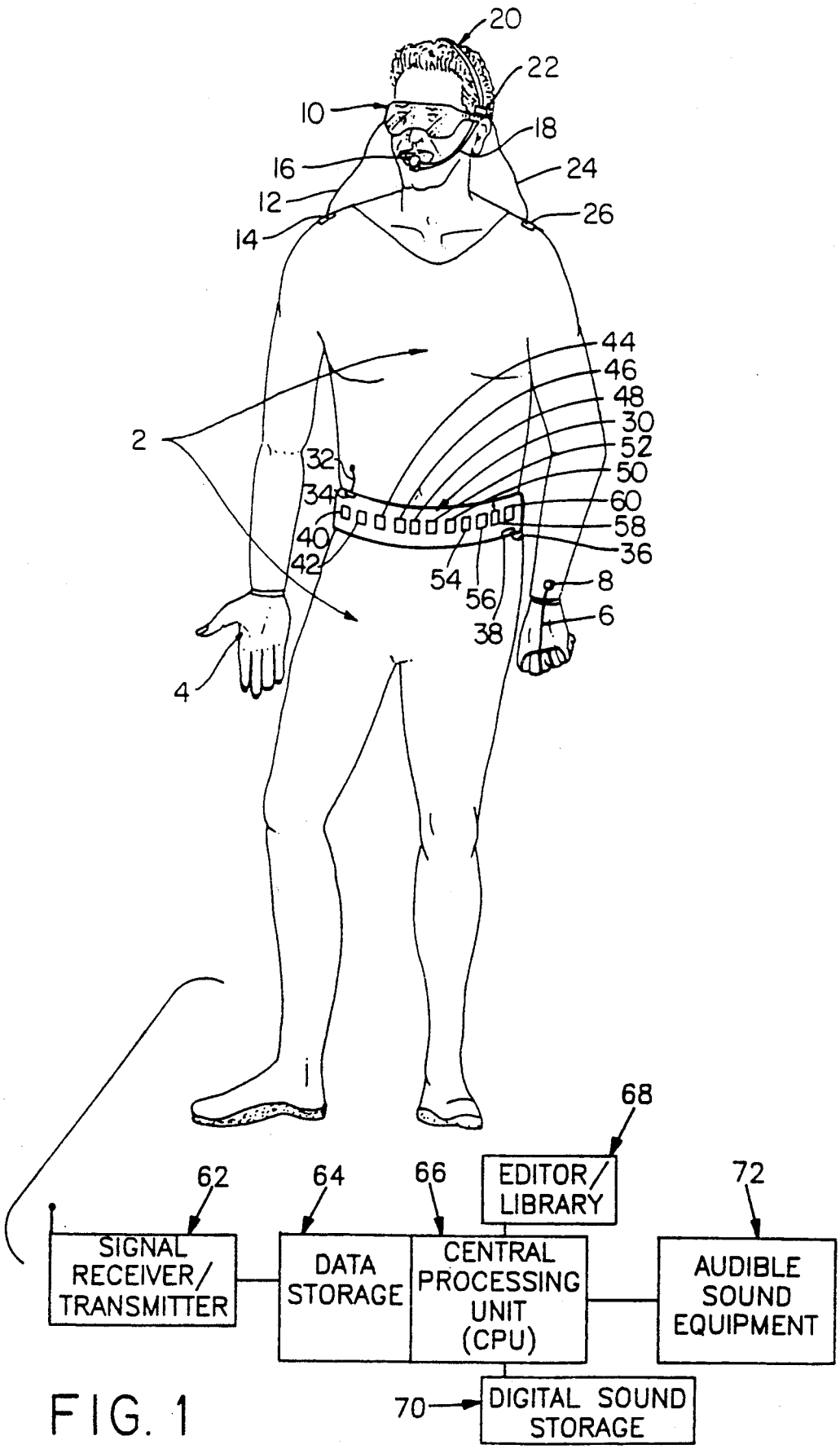
FIG. 1 is a schematic representation of an orchestrator employing the apparatus of the subject invention.

Returning to FIG. 1, an optional head-worn video screen 10, similar to the one developed by VPL Research, is connected to the suit 2 by a cable 12. An optional microphone 16 is mounted on a bracket 18 which is fixed to the orchestrator by headstrap 20, and may be used for both programming and performance activities. A headstrap 20 is used to mount a motion detecting device 22, such as a mercury switch, which can be easily configured through available processing means into the preferred embodiment of motion detection. Cables 12 and 24, connect to wiring stitched into the suit 2 at electrical connectors 14 and 26, respectively, which are also stitched into the suit 2. The cables 12 and 24 allow for the flow of electronic information between head mounted video screen 10, the head mounted motion detection device 22, the microphone 16, and a belt 30 that is fixed to the orchestrator's waist.

The belt 30 supports a number of interconnected signal processing means for storing, manipulating, transmitting, and receiving electronic information. If a two-piece suit 2 is used, electronic wiring stitched into the upper body portion of the suit 2 is connected to the belt 30 via a cable 32 at an electrical connector 34. Wiring stitched into the lower body portion of the suit is connected to the belt 30 via a cable 36 at an electrical connector 38. The signal processing means supported by the belt 30 in the preferred embodiment includes a power source 40, a glove control input signal buffer 42, a motion detector input signal buffer 44, a voice input signal buffer 46, a signal amplifier 48, an analog/digital converter 50, a micro-controller 52, a MIDI translator 54, a video signal control unit 56, a wireless output signal transmitter 58, and a motion detection device 60. For ease of configuration into the preferred embodiment, motion detection device 60 is assumed to be a mercury switch. One application of belt-mounted motion detection device 60 is to provide a baseline signal against which other motion sensors may be measured, thus serving as a default axis of measurement. In addition, the belt-mounted motion detection sensor 60 can be related electronically to axes of measurement not located on the body, which could ultimately reduce position calculation and processing steps.

Electronic signals received by the belt 30 at the electrical connectors 34 and 38 are routed accordingly to appropriate buffers. The micro-controller 52 then performs tasks by processing means using other belt-supported signal processors to ultimately control the flow of digitized data signals from the wireless signal transmitter 58 to the signal receiver/transmitter 62 located separately from the orchestrator. Motion signals from the suit 2, the headgear 22, and the belt 30 will be routed from motion detector input signal buffer 44 to the signal amplifier 48, if necessary, prior to signal consolidation via the micro-controller 52, the analog-to-digital converter 50, and subsequent wireless output data transmitter 58. Use of the signal amplifier 48 on the belt 30 will depend upon the operating requirements of the system and will be limited to signals that need to be either stepped-up or stepped-down to work within the system's operating environment.

Signals from the glove controllers 4 will be routed from the glove control input signal buffer 42 to the signal amplifier, 48, if necessary, prior to signal consolidation via the micro-controller 52, the analog-to-digital converter 50, the MIDI translator 54, if necessary, and the subsequent wireless output signal transmitter 58. The need for MIDI interpretation 54 will be triggered by instructions from the glove controller 4 as interpreted by the micro-controller 52. Triggering of one or a combination of sensors 74-90 on the glove controller 4 will indicate to the micro-controller 52 that a user- or system-specific MIDI command is to be interpreted prior to wireless output signal transmitter 58 to simplify processing steps at other signal processing locations.

Voice signals from microphone 16 will be routed from voice input signal buffer 46 to the signal amplifier 48, if necessary, prior to the analog-to-digital converter 50 and the subsequent wireless output signal transmitter 58. Video signals received from signal receiver/transmitter 62 not attached to the orchestrator will be routed from video signal control unit 56 by the micro controller 52 to the signal amplifier 48, if necessary, prior to subsequent routing to head-mounted video screen 10. Signals transmitted by wireless output signal transmitter 58 will be received by signal receiver/transmitter 62 and stored subsequently in data storage 64. Central processing unit (CPU) 66 will then interact with data storage 64, the signal transmitter/receiver 62, an editor/library processing means 68, a digital sound processing means 70, and with audible sound equipment 72 to orchestrate motion with sound as instructed by the orchestrator.

Figure 3:
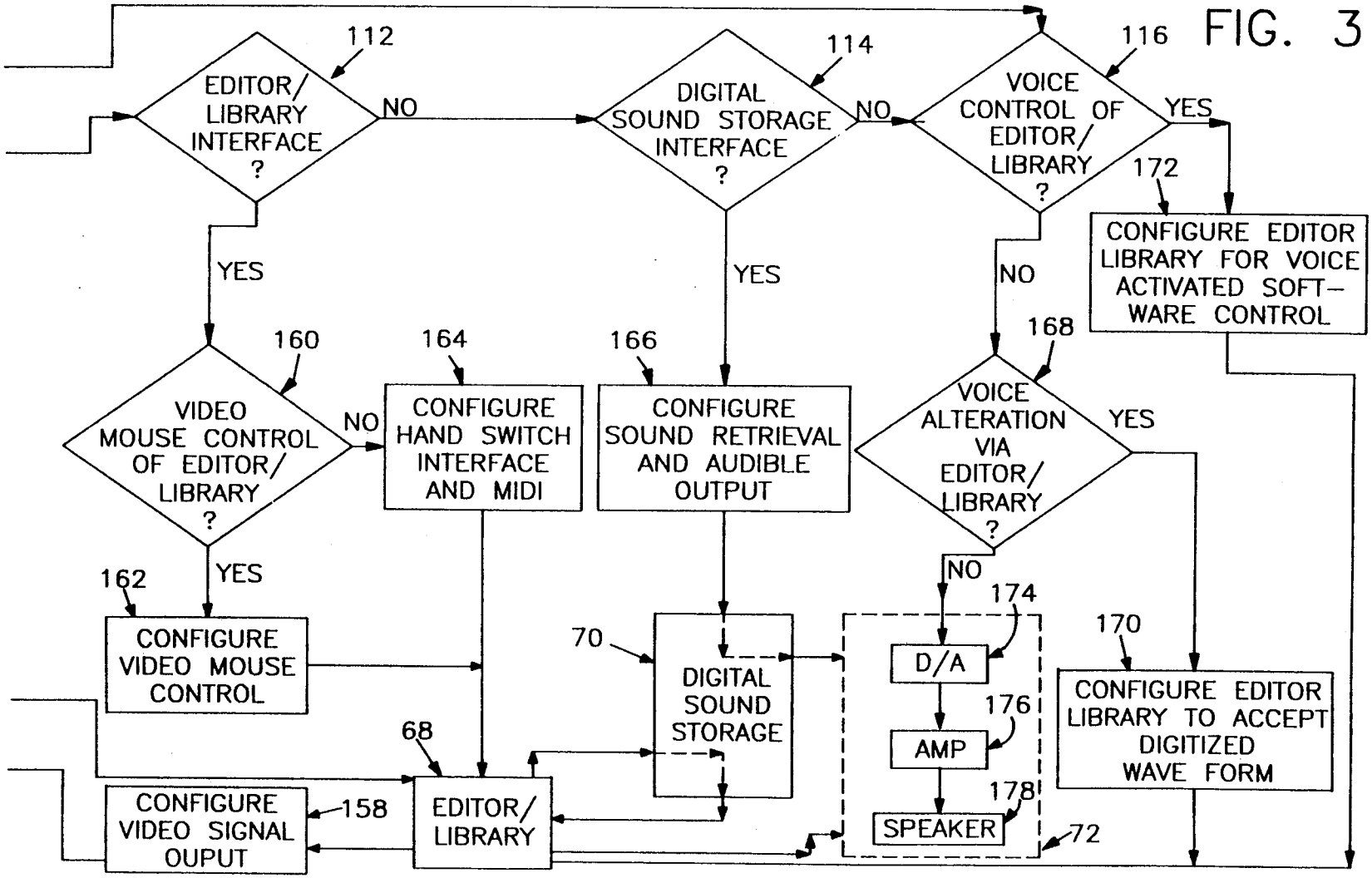
FIG. 3 is a schematic depiction of a flow diagram demonstrating a process carried out by the apparatus illustrated in FIG. 1.

FIG. 3 is a flow diagram that depicts the processing of signals once they enter the data storage 64 and are manipulated subsequently by the CPU 66 processing means. Hand switch signals 102 represent instructional information of the motion orchestration system. In the CPU 66, determinations are made as to whether or not hand switch signals 102 will activate processing related to a motion signal 104 interface, editor/library 68 interface, or digital sound storage 70 interface at 110, 112, and 114, respectively. If hand switch signal instructions 102 are related to motion signals 104, a decision is made by processing means 110 as to whether or not the hand switch signals 102 indicate that body position information must be processed at 120. If body position is not relevant to the application, as dictated by CPU 66 interpretation of the hand switch signals 102, then the motion signals 104 are configured via processing means at 156 to be accepted by the editor/library 68 as digital waveforms to be subsequently altered. In such instances, it would be the orchestrator's desire to produce sounds that fluctuate as the body moves, independent of the position of the body segments. An editor/library 68 such as the Sound Tools system by Digidesign could accept configured digitized waveforms from 156 and could be operated subsequently by a number of scenarios described in detail herein to produce the desired effect.

If hand switch instructional signals 102 indicate at 120 that body positions are relevant to the application, a series of processing steps ensue to account for axes other than default, which could be defined at the belt 30 by motion sensor 60, to account for velocity and/or acceleration of motion, and to account for selected body segments. If the orchestrator wants only leg movements of the system to be manipulated, then sensors on the glove controller 4 will be depressed in a predetermined manner to provide this instructional information. Processing will occur in the CPU 66 based upon hand switch signals 102 to have motion signals routed from node 122 to node 150 via nodes 128, 138, 140, 144 and 146, such that leg motion signals can be isolated at 152 and converted subsequently into three-space vectors at 154 for configuration and use within the editor/library 68 via processing means at 156.

Shifting the default axis to the head-mounted motion sensor 22 would require signal routing from node 122 to node 132 via nodes 124 and 130; the alternative axis at the head-mounted motion sensor 22 would be identified at 126 and appropriate three-space vector calculations would take place at 154 prior to editor/library 68 configuration at 156. If hand switch signals 102 indicate that leg movements be considered, but the axis of measurement is located at head mounted motion sensor 22, signals would be routed from node 122 to node 150 Via nodes 124, 130, 136, 138, 140, 144 and 146. A person witnessing an orchestrated performance under this scenario could see the orchestrator marching in place while periodically bobbing and weaving the head and upper body to displace the axis from which leg positions are measured. Each bob and weave of the head would result in a deformation or change of the sound produced by the motion orchestration system. The sounds produced by the leg motion would remain unaltered if the hand switch signals 102 did not identify the moveable axis.

If hand signals 102 dictate that velocity and/or acceleration are relevant to system dynamics, signals would be routed from node 122 to node 148 via nodes 128, 138, 136, 130, 134 and 146 such that processing at 142 can occur to enable calculations of three-space vectors at 154 for subsequent configuration at 156 prior to manipulation within editor/library 68. If velocity and acceleration are to affect leg movements only, signals would be routed from node 122 to node 150 via nodes 128, 138, 136, 130, 134 and 146. If the orchestrator wishes to have an alternate axis defined for velocity and acceleration modification of leg movements only, signals would be routed from node 122 to node 150 via nodes 124, 130, 134 and 146 for processing at 126, 142 and 152 prior to vector calculation at 154, configuration at 156 and processing within the editor/library 68. In the last permutation of position-related movements, velocity and acceleration can affect movements defined according to an alternate axis when signals are routed from node 122 to node 148 via nodes 124, 130, 134 and 146, with processing occurring at 126 and 142 prior to vector calculation at 154, configuration at 156, and processing within the editor/library 68.

The relevance of a hand switch signal 102 to control of or operation within editor/library 68 will be determined by processor means at 112. Hand switching using the glove controller 4 can represent two different types of control interfaces with the editor/library 68. Assuming that an orchestrator is not performing a complex series of movements that requires visualization of surroundings, the orchestrator can use arm movements to guide a cursor seen on head-mounted video screen 10 to control software operations while remaining active in the system environment. This process is similar to the use of a conventional "mouse" software controller; hand switching from the glove controller 4 performed when arm motions move a cursor over software commands seen on the head-mounted video screen 10 can control processing means such as the editor/library 68. Thus, the orchestrator will don the head-mounted video screen 10 and indicate to the system via the glove controller 4 that editor/library 68 or other processing means is to be put into operation at 112. If the software is to be operated using arm movements similar to a conventional "mouse" control, commands from glove controller 4 will be interpreted as such at 160, necessary processing will take place at 162 and the orchestrator will then be free to operate within the software environment using hand switch signals 102 and arm motion signals to guide the mouse, the processing of which having been described previously. The image provided by editor/library 68 or other processing means in operation will be processed at 158 prior to temporary storage as output video signals 106 at the data storage 64. Signals will be transmitted via the signal transmitter/-receiver 62, received by the orchestrator at the video signal control unit 56, channeled through internal wiring in the suit 2 and external wiring at 12 and subsequently seen on head-mounted video screen 10.

Hand switch signals 102 can operate within editor/library 68 or other software environments and represent "mouse" control of the software. As stated previously, numerical information can be provided to the system via glove controller 4 using Chisembop. Within the editor/library 68 environment, numbers can be interpreted as MIDI numerical instructions; identifiers for sounds, motions, sound/motion couples, or a sequence of sounds or sound/motion couples; or other instructional information of relevance to the system. This application is not limited to input of numbers via Chisembop; combinations of sensors mounted on glove controller 4 can represent instructional and operational information of relevance to the system. Tracing the path of information in FIG. 3, hand switch signals 102 identify interface with editor/library 68, whereupon additional processing means at 160 identifies that the signals represent MIDI or other instructional information of relevance to editor/library 68. Processing occurs at 164 followed by operation within the editor/library 68 environment. This feature is important to the motion orchestration system in that the need for the use of head-mounted video screen 10 becomes minimized when hand instructions directly trigger system responses that do not require visualization of operating software, particularly during a complicated performance.

An example of operation within the motion orchestration system without using the head-mounted video screen 10 to achieve a desireable end is as follows. The orchestrator is performing a dance that has a pre-programmed sequence of motion-coupled sounds. During the performance, the orchestrator wishes to improvise and begin substituting other sounds into the dance. Without breaking the continuity of the performance, the orchestrator enters a series of commands into the system via glove controller 4 that identify at 114 that interface with digital sound processing 70 is required. Instructional information is processed at 166 followed by the retrieval of the desired sound, either by direct input of a numerical identifier or by random sampling from digital sound processing 70. The Emulator Three system by E-mu Systems, Inc. could be used for this application. If tailoring of the sound is desired, interface with editor/library 68 is processed as described previously and the digital sound patch is routed to audible sound equipment 72 where it is converted to an analog signal at 174, amplified at 176, and produced as audible output at 178. The use of the aftertouch feature from sensor 78 could be employed when a new sound is selected, particularly if the sound is more effective aesthetically at a different volume. Once the desired sound is produced and found to be of unsatisfactory volume, hand switch signals may be interpreted to allow for real time amplification of a sound based upon the length of pressure applied to sensor 78. The sensor could be activated by striking the second finger to the palm, the sound would increase in volume based upon previous instructional information interpreted from glove controller 4, and the sensor could be subsequently depressed by lifting the finger once the desired volume is reached. If other aftertouch-configured sensors are programmed to represent the volume of other sounds already coupled with motions that are not being substituted, these volumes may be altered similarly to balance the change realized from the new sound. Additional instructions would be finger switched into the motion orchestration system via the glove controller 4 to indicate that the use of the sensor 78, or any of the other aftertouch configured sensors, to alter volume by aftertouch is no longer applicable and that other instructions are to be followed.

Vocal signals 100 detected by the microphone 16 can be manipulated in essentially three different ways within the motion orchestration system. First, hand switch signals 102 could indicate that vocal signals 100 should control the editor/library 68 or other applications at 116. Processing means at 172 would enable voice activated control of software applications for the editor/library 68. If voice control of 68 is not the desired operation as instructed by hand switch signals 102, then processing means at 168 would determine if voice signals 100 are to be produced audibly with or without modification. If modification is not required for the voice signals 100, then analog conversion at 174, amplification at 176, and sound generation at 178 would occur within the audible sound production equipment 72. If, however, some aspect of the voice signal 100 is to be altered within the editor/library 68, such as the addition of echo, pitch alteration, or some other effect, processing means at 170 would initiate this activity prior to signal modification within the editor/library 68.

Using the preferred embodiment of the invention, a number of operating scenarios are disclosed herein which demonstrate the novelty and versatility offered by the motion orchestration system. The orchestrator, equipped with a motion orchestration system, introduces power to the body-based components shown in FIG. 1 via the power source 40. Since the first application is to couple a series of movements with sounds in a nonperformance atmosphere, the head-mounted video screen 10 is connected to the suit 2 via cable 12. The orchestrator enters a series of commands via the glove controller 4 that indicate that "mouse" control of software will be used. The program is displayed subsequently on the head-mounted video 10 and the orchestrator begins moving his arm up and down and side to side, positioning the cursor seen on head-mounted video screen 10 over software commands, while using one of the sensors on the glove controller 4 to activate the software commands desired. At this juncture, the orchestrator selects a position tracking application. Further instruction dictates that a sequence of sounds and commands is forthcoming that will ultimately be stored together in a computer memory with fixed positions detected by the suit 2 and interpreted by processing means described previously. The "mouse" selects an application that will enable the orchestrator to identify the performance for future reference. The response from the orchestrator is to hand switch a series of numbers using Chisembop, combined with a series of hand switches that are not numerically significant, but are nonetheless relevant to the orchestrator, that will be used to identify the motion-coupled sounds. The orchestrator is essentially constructing a "macro" of hand switches that when triggered later, will immediately produce the desired sound or effect when the motion is performed. The macro of hand switches would have the effect of minimizing the visual impact of switching that occurs during a performance while simplifying the process of selecting motion orchestration system applications.

Once the orchestrator has given the routine to be programmed an identifier and has established other system attributes, such as axis of measurement, then software commands are given that inform the system that the legs will be used exclusively for the routine. A start position-tracking command is given via the glove controller 4, the orchestrator lifts one leg and then the other in succession, and then a stop position-tracking command is given. The up-and-down marching movements of the legs is to be coupled with sounds that the orchestrator will select in a time frame that will be established using MIDI interface within editor/library 68. By a series of instructions from the glove controller 4 and the mouse, the system is prepared to retrieve, alter, store, and couple sounds with the prescribed motion. Digital sound processing 70 is scanned to retrieve the prerecorded digitized sound of soldiers marching on pavement. When the sound is retrieved, the vector that represents the straight leg position for each leg is coupled with the sound within memory. Thus, when either foot hits the ground, the sound of the march will be sent from editor/library 68 to audible sound production 72 and heard subsequently. Use of the identifier prior to the movement will have processing occur in editor/library 68 by a series of macros to retrieve the sound from digital sound processing 70 for subsequent sequenced use.

Having identified one sound-motion couple within the routine, the orchestrator now wishes to concentrate on coupling sound with the rest of the movement. The sound chosen is a digitized sample of a flame thrower. Using editor/library 68 applications in conjunction with the digitized sound processing equipment 70, the sampled sound is retrieved, scanned, and edited so that only a brief portion of the original digitized sound remains. This desired portion will be coupled with the wave pattern defined by the vectors from the upward motion of the leg from the extended position to the compressed position using Fast Fourier Transform (FFT) techniques that are established within the art. By assigning a reversed playback of the newly motion-coupled sound to the leg extension portion of the movement, an effect similar to breathing in and breathing out is produced when the leg is raised and lowered that is interrupted periodically with the sound of the march when the leg is fully extended.

During performance, head-mounted video screen 10 may be removed and control is provided by glove controller 4 using macros and numbers as described previously as well as using vocal controls of software. Improvisation during the performance, one of the most beneficial aspects of the music orchestration system, can take many forms. A vocal recitation during the marching routine can be sampled, stored in digital sound processor 70, and substituted for the sound of the flame thrower with leg motions providing different effects upon the voice. Examples are increase and decrease in volume of the voice as the legs are raised and lowered or increase and decrease in vocal pitch as the motion occurs. The sound coupling principle programmed for leg motion can be applied to arm motion by use of macros via hand switching. A new axis with different degrees of freedom of movement can be defined that can provide significant sound altering effects during the routine. The potential for locating the axis on another individual operating within the system expands the capabilities of improvisation and motion orchestration. For instance, several orchestrators operating within the same system can define sound/motion couples for each other based upon their own use of system commands. Thus, the marching routine performed by one orchestrator could have the originally motion-coupled sounds replaced by the voice of another orchestrator, with the head of a third orchestrator defined as the axis of measurement, as dictated by the hand switching of a fourth orchestrator whose motions are being coupled with sounds according to instructions dictated by the other three.

As can be seen, a number of applications are at the disposal of the orchestrator when the use of hand switching is employed to control other signal generators. The descriptions presented herein in no way limit the numerous applications that may be employed by this invention but shall be inclusive of many other variations that do not depart from the broad interest and intent of the invention as defined by the claims.

I claim:

1. A motion orchestration system for use by an orchestrator comprising:

a plurality of output signal generators for generating an array of output signals, a plurality of said output signal generators comprising motion sensors mounted to selected extremities on the body of the orchestrator spaced from the hands of the orchestrator for generating an array of output signals in response to selected movements of the orchestrator;

at least one control signal generator defining at least one contact sensitive switch mounted to at least one hand of the orchestrator at a location accessible to fingers of the orchestrator, such that movements of the fingers of the orchestrator are capable of generating control signals for manipulating the output signals generated from the output signal generators;

signal transmitting means mountable to the orchestrator for transmitting the output signals from the motion sensors as manipulated by the control signals;

signal receiving means for receiving the manipulated output signals from the signal transmitting means; and signal processing means operatively connected to the signal receiving means for converting the manipulated output signals into a selected array of sounds, whereby the output signals can be generated by movement of the orchestrator's extremities and whereby the output signals can be manipulated by selected movements of the fingers of the orchestrator without detracting from visual appearance of the orchestrator's movements.

2. A motion orchestration system, as in claim 1 wherein each of the motion sensors generates an output signal responsive to the relative position of the associated motion sensor.

3. A motion orchestration system, as in claim 1 wherein each of the motion sensors generates a signal response to the velocity of movement of the associated motion sensor.

4. A motion orchestration system, as in claim 1 wherein each of the motion sensors generates a signal corresponding to acceleration of the respective motion sensor.

5. A motion orchestration system as in claim 1 wherein the motion sensors comprise a plurality of mercury switches.

6. A motion orchestration system as in claim 1 further comprising a bodysuit to be worn over the legs, torso and arms of the orchestrator, each of the motion sensors being connected to portions of the bodysuit.

7. A motion orchestration system as in claim 1 wherein each of the control signal generators comprises a contact sensitive switch mounted to at least selected fingers of the orchestrator.

8. A motion orchestration system as in claim 7 further comprising at least one glove to be worn by the orchestrator, the contact sensitive switches being mounted to the glove.

9. A motion orchestration system as in claim 1 wherein the signal receiving means and the signal processing means are disposed at locations remote from the orchestrator.

10. A motion orchestration system as in claim 1 wherein at least one of the output signal generators is disposed at a location spaced from the orchestrator, the control signal generator being operatively connected to the signal transmitting means such that the control signal generator is operative to manipulate output signals from the output signal generator spaced from the orchestrator.

11. A motion orchestration system as in claim 1 wherein at least one of the output signal generators comprises a microphone responsive to voice signals generated by the orchestrator.

12. A motion orchestration system as in claim 1 further comprising an analog to digital converter mountable to the orchestrator and operatively connected to the output signal generators and to the signal transmitting means for converting analog signals from the output signal generators into digital signals.

13. A motion orchestration system as in claim 1 further comprising a micro controller mountable to the orchestrator and operatively connected to the output signal generators and the control signal generators, the micro controller being operative to consolidate signals generated by the output signal generators and the control signal generators.

14. A motion orchestration system as in claim 1 further comprising a MIDI translator for receiving the manipulated output signal and translating the manipulated output signals into MIDI configured signals.

15. A motion orchestration system as in claim 1 further comprising a video output display operatively connected to the signal processing means for providing video displays indicative of the control signals and the manipulated output signals.

16. A motion orchestration system as in claim 15, wherein the video display means is mountable to the head of the orchestrator.

17. A motion orchestration system as in claim 1 further comprising an audio output means operatively connected to the signal processing means for providing audio outputs indicative of the manipulated output signals.

18. A motion orchestration system for use by an orchestrator comprising:

at least one output signal generator mounted to extremities of the orchestrator and spaced from the hands of the orchestrator for generating an array output signals in response to movements of the extremities of the orchestrator;

at least one control signal generator mounted to at least one hand of the orchestrator and responsive to selected movements of fingers of the hand of the orchestrator for generating control signals for manipulating the output signals generated from the output signal generators;

signal transmitting means mountable to the orchestrator for transmitting the signals from the signal generator mounted to the orchestrator;

signal receiving means for receiving the signals from the signal transmitting means; and signal processing means operatively connected to the signal receiving means and to the output signal generator for manipulating the output signals in accordance with the control signal to produce an orchestrated array of music, whereby the output signals can be generated by movement of the orchestrator's extremities and whereby the motion-generated output signals can be manipulated by selected movements of the fingers of the orchestrator without detracting from visual appearance of the orchestrator's movements.

19. A motion orchestration system as in claim 18 wherein the control signal generators comprise a contact sensitive switch mounted to at least selected fingers of the orchestrator.

20. A motion orchestration system as in claim 19 further comprising at least one glove to be worn by the orchestrator, the contact sensitive switches being mounted to the glove.

21. A motion orchestration system as in claim 18 wherein the output signal generator mounted to the body of the orchestrator comprises a microphone.

22. A motion orchestration system as in claim 18 further comprising a video output display operatively connected to the signal processing means for providing video displays indicative of the control signals and the manipulated output signals.

* * * * *